United States Patent [19]

Ishikawa et al.

[11] Patent Number: 5,019,850

[45] Date of Patent: May 28, 1991

[54] PHOTOGRAPHIC DEVELOPING APPARATUS

[75] Inventors: Takatoshi Ishikawa, Kanagawa; Shigemi Saito, Tokyo; Kazuaki Yoshida; Yoshihiro Fujita, both of Kanagawa, all of Japan

[73] Assignee: Fuji Photo Film Co., Ltd., Kanagawa, Japan

[21] Appl. No.: 395,673

[22] Filed: Aug. 18, 1989

[30] Foreign Application Priority Data

| | | | |
|---|---|---|---|
| Aug. 19, 1988 | [JP] | Japan | 63-205880 |
| Aug. 19, 1988 | [JP] | Japan | 63-205881 |
| Aug. 19, 1988 | [JP] | Japan | 63-205882 |

[51] Int. Cl.[5] ..... G03D 3/06; G03D 3/08

[52] U.S. Cl. ..... 354/322; 354/324

[58] Field of Search ..... 354/320, 321, 322, 324, 354/298

[56] References Cited

U.S. PATENT DOCUMENTS

| | | | |
|---|---|---|---|
| 4,081,816 | 3/1978 | Geyken et al. | 354/324 |
| 4,329,042 | 5/1982 | Libicky et al. | 354/324 |
| 4,451,132 | 5/1984 | Kishimoto | 354/324 |

FOREIGN PATENT DOCUMENTS

| | | |
|---|---|---|
| 996410 | 8/1957 | Fed. Rep. of Germany . |
| 1290812 | 6/1965 | Fed. Rep. of Germany . |
| 2059988 | 12/1970 | Fed. Rep. of Germany . |
| 2226770 | 6/1972 | Fed. Rep. of Germany . |
| 2748430 | 10/1977 | Fed. Rep. of Germany . |
| 45-8506 | 3/1970 | Japan . |
| 45-8836 | 3/1970 | Japan . |
| 49-42434 | 4/1974 | Japan . |
| 49-59644 | 6/1974 | Japan . |
| 50-140129 | 11/1975 | Japan . |
| 5372623 | 6/1976 | Japan . |
| 52-20832 | 2/1977 | Japan . |
| 53-28426 | 3/1978 | Japan . |
| 53-32735 | 3/1978 | Japan . |
| 53-32736 | 3/1978 | Japan . |
| 53-37418 | 4/1978 | Japan . |
| 53-57831 | 5/1978 | Japan . |
| 53-94927 | 8/1978 | Japan . |
| 53-95630 | 8/1978 | Japan . |
| 53-95631 | 8/1978 | Japan . |
| 53-104232 | 9/1978 | Japan . |
| 53-124424 | 10/1978 | Japan . |
| 53-135628 | 11/1978 | Japan . |
| 53-141623 | 12/1978 | Japan . |
| 54-35727 | 3/1979 | Japan . |
| 55-26506 | 2/1980 | Japan . |
| 56-64339 | 6/1981 | Japan . |
| 57-8543 | 1/1982 | Japan . |
| 57-144547 | 9/1982 | Japan . |
| 57-157243 | 9/1982 | Japan . |
| 58-14834 | 1/1983 | Japan . |
| 58-16235 | 1/1983 | Japan . |
| 58-115438 | 7/1983 | Japan . |
| 58-163940 | 9/1983 | Japan . |
| 60-220345 | 11/1985 | Japan . |
| 62-28838 | 2/1987 | Japan . |
| 62-288838 | 12/1987 | Japan . |

*Primary Examiner*—A. A. Mathews

*Attorney, Agent, or Firm*—Sughrue, Mion, Zinn, Macpeak & Seas

[57] ABSTRACT

A photographic developing apparatus of the type in which development is effected by passing exposed sensitive material (principally one for printing such as photographic paper) successively through a developing vessel, a bleaching/fixing vessel, and a rinsing vessel. The bleaching/fixing vessel is replenished with a mixture of concentrated processing liquid and liquid extracted from the rinsing vessel, so that the amount of processing liquid discharged from the rinsing vessel as overflow is reduced, thereby alleviating the burden of waste liquid disposal.

When the exposed sensitive material to be processed is principally one for photographing such as negative film or reversal film, the material is successively passed through a developing vessel, a bleaching vessel, a fixing vessel, and a rinsing vessel, or through a developing vessel, a bleaching vessel, a bleaching/fixing vessel, and a rinsing vessel, so that concentrated processing liquid and liquid extracted from the rinsing vessel are supplied to the fixing vessel or the bleaching/fixing vessel which is immediately before the rinsing vessel.

40 Claims, 6 Drawing Sheets

PHOTOGRAPHIC DEVELOPING APPARATUS

BACKGROUND OF THE INVENTION

1. Field of the Invention

This invention relates to a photographic developing apparatus for developing sensitive material after exposure of its images.

2. Description of the Related Art

In a photographic developing apparatus, the development of sensitive material (when it is one for printing such as photographic paper) is effected by successively passing it through a developing vessel, a bleaching/fixing vessel, and a rinsing vessel which constitutes a water washing and/or stabilizing vessel. When principally treating a sensitive material for photographing such as negative film or reversal film, development is effected by successively passing the material through a developing vessel, a bleaching vessel, a fixing vessel, a water washing vessel, and a stabilizing vessel, or through a developing vessel, a bleaching vessel, a bleaching/fixing vessel, a water washing vessel, and a stabilizing vessel. The developing vessel, the bleaching vessel, the fixing vessel, and the bleaching/fixing vessel are supplied with replenisher so as to compensate for any deterioration in or decrease through evaporation of the processing liquids. The resulting overflow of the processing liquid is discharged from these processing vessels.

The water washing vessel and the stabilizing vessel are also supplied with water (liquid) for the purpose of washing the developed component, as well as the component which has been bleached and fixed, away from the sensitive material, resulting in the washing water and the stabilizing liquid also being contaminated. Accordingly, these vessels are supplied with replenishing washing water or stabilizing liquid, the resulting overflow of these liquids being discharged from the vessels.

It is desirable that the amount of these waste liquids be kept as small as possible since they require a particular waste liquid disposal processing. However, it is quite difficult to reduce the waste liquid amount while maintaining a certain level of developing capacity.

A solution to this problem has been proposed by Japanese Patent Laid-Open No. 57-157243 according to the disclosure of which overflow in a preliminary water washing vessel is transferred to a fixing vessel which constitutes the vessel for the preceding bath. However, stable processing cannot always be ensured solely by transferring overflow in this way since that will involve a fluctuation in the overflow amount due to evaporation, etc., which causes the composition of the bleaching/fixing liquid to fluctuate, resulting in poor desilverization, an undesirable color stain, etc.

SUMMARY OF THE INVENTION

It is accordingly an object of this invention to provide a photographic developing apparatus which allows the waste liquid amount to be reduced while maintaining a desired processing capacity and which makes it possible to perform developing operations in a stable manner.

When the present invention is principally applied to a sensitive material for printing such as photographic paper, development is effected by successively passing exposed sensitive material through a developing vessel, a bleaching/fixing vessel, and a rinsing vessel, concentrated replenishment liquid for bleaching and fixing being diluted with liquid extracted from the rinsing vessel before it is supplied to the bleaching/fixing vessel.

When the present invention is principally applied to a sensitive material for photographing such as negative film or reversal film, exposed sensitive material is successively passed through a developing vessel, a bleaching vessel, a fixing vessel, a water washing vessel, and a stabilizing vessel, or through a developing vessel, a bleaching vessel, a bleaching/fixing vessel, a water washing vessel, and a stabilizing vessel, concentrated replenishment liquid being diluted with liquid extracted from the water washing vessel before it is supplied to the fixing vessel or the bleaching/fixing vessel which is immediately before the water washing vessel.

Thus, in accordance with this invention, the replenisher supplied to the bleaching/fixing vessel or the fixing vessel consists of a mixture of concentrated processing liquid and liquid extracted from the water washing or stabilizing vessel, so that the amount of waste liquid which is to be discharged from the water washing or stabilizing vessel is smaller than in conventional apparatuses by the amount of liquid which is thus extracted therefrom, thereby reducing the total amount of waste liquid to be discharged from the entire apparatus.

When the amount of liquid transferred from the water washing or stabilizing vessel to the bleaching/fixing vessel is much smaller than the amount of replenishing liquid supplied to this water washing or stabilizing vessel, no particular problem is involved since the water level of the water washing or stabilizing vessel is not materially lowered. However, if the amount of liquid transferred from the water washing or stabilizing vessel to the bleaching/fixing vessel is equal to or larger than the replenishing amount supplied to this water washing or stabilizing vessel, the water level of this vessel can be lowered. Accordingly, some means must be adopted to change the amount of liquid to be supplied to the water washing or stabilizing vessel so that the water level of this vessel will not be lowered.

The color developer used in this invention is preferably an alkaline aqueous solution whose main component is a color developing agent of the aromatic primary amine type. While an aminophenol system compound will also prove useful as the color developer, most preferable is a p-phenylenediamine system compound. Typical examples of such a compound include 3-methyl-4-amino-N, N-diethylaniline, 3-methyl-4-amino-N-ethyl-N-$\beta$-hydroxyethylaniline, 3-methyl-4-amino-N-ethyl-N-$\beta$-methane sulfonamide ethylaniline, and 3-methyl-4-amino-N-ethyl-N-$\beta$-methoxyethylaniline as well as sulfates, hydrochlorides, or p-toluenes thereof. Two or more of these compounds may be adopted in combination in accordance with the purpose for which the color developer is used.

Generally, the color developer contains a pH restrainer such as a carbonate, borate or phosphate of an alkali metal, and a development restrainer or fogging inhibitor such as a bromide, iodide, benzimidazoles, benzothiazoles, mercapto compound, etc. Further, the color developer may contain the following, as needed: preservatives such as hydroxylamine, diethylhydroxylamine, sulfite, hydrazines, phenylsemicarbazides, triethanolamine, catechol sulfonates, triethylenediamine (1,4-diazabicyclo[2,2,2]octane), an organic solvent such as ethylene glycol and diethylene glycol, a development accelerator such as benzyl alcohol, polyethylene glycol, quaternary ammonium salt, and amines, a fogging agent such as pigment forming coupler, competitive coupler, and sodium boron hydride, an auxiliary developer such as 1-phenyl-3-pirazolidone, a viscosity furnishing agent, and chelating agents such as aminopolycarboxylic acid, aminopolyphosphonic acid, alkylphosphonic acid, and phosphonocarboxylic acid. Typical examples of such chelating agents include: ethylenediamine tetra-acetic acid, nitrilotriacetic acid, diethylenetriamine penta-acetic acid, cyclohexanetriamine tetra-acetic acid, hydroxyethyl iminodiacetic acid, 1-hydroxyethylidene-1, 1-diphosphonic acid, nitrilo-N,N,N-trimethylene phosphonic acid, ethylenediamine-N,N,N',N'-tetramethylene phosphonic acid, ethylenediamine-di (0-hydroxyphenylacetic acid) and salts thereof.

The replenishing amount of these color developers depends on the type of color photograph sensitive material. Generally speaking, the replenishing amount does not exceed 3 l per 1 square meter of the sensitive material. It can be kept to 50 ml or less by reducing the bromide ion concentration in the replenisher. When reducing the replenishing amount, it is desirable that the opening area of the processing vessel be diminished so as to prevent the liquid from being evaporated or oxidized. The replenishing amount may be reduced by adopting a means for restraining the bromide ion accumulation in the developer.

The emulsion layer of a photograph after color development is subjected to the bleaching/fixing processing. The fixing may be effected prior to the bleaching/fixing processing, or the bleaching may be effected after the bleaching/fixing, depending on the purpose. The bleaching agent may, for example, be a composite of a polyvalent metal such as iron (III), cobalt (III), chromium (VI), and copper (II), peroxides, quinones, a nitro compound, etc. Typical examples of bleaching agents include: ferricyanides; bichromates; an organic complex salt of iron (III) or cobalt (III), such as aminopolycarboxylic acids including ethylenediamine tetraacetic acid, diethylenetriamine pentaacetic acid, cyclohexanediamine tetraacetic acid, methyliminodiacetic acid, 1,3-diaminopropane tetraacetic acid, glycoletherdiamine tetraacetic acid, or complex salts of citric acid, tartaric acid, malic acid, etc.; persulfate; bromate; permanganate; nitrobenzenes, etc. Of these, iron aminopolycarboxylates (III) such as iron ethylenediamine tetraacetate (III) are particularly preferable since they allow quick processing and involve little environmental pollution.

A bleaching accelerator may be employed in the bleaching/fixing acid as well as in the preceding bath thereof. Examples of useful bleaching accelerators are as follows: the compounds having mercapto groups or disulfide groups disclosed in U.S. Pat. No. 3,893,858, West German Patents No. 1,290,812 and 2,059,988, Japanese Patent Laid-Opens No. 53-32,736, 53-57,831, 53-37,418, 53-72,623, 53-95,630, 53-95,631, 53-104,232, 53-124,424, 53-141,623, and 53-28,426, and Research Disclosure No. 17,129 (July, 1978), etc.; the thiazolizine derivatives disclosed in Japanese Patent Laid Open No. 50-140,129; the thiourea derivatives disclosed in Japanese Patent Publication No. 45-8,506, Japanese Patent Laid-Opens No. 52-20,832 and 53-32,735, and U.S. Pat. No. 3,706,561; the iodide salts disclosed in Japanese Patent Laid-Open No. 58-16,235; the polyoxyethylene compounds disclosed in West German Patents No. 966,410 and 2,748,430; the polyamine compounds disclosed in Japanese Patent Publication No. 458836; the compounds disclosed in Japanese Patent Laid-Opens No. 49-42,434, 49-59,644, 53-94,927, 54-35,727, 55-26,506, and 58-163,940; and bromide ions, etc. Of these, compounds having mercapto groups or disulfide groups are particularly preferable since they provide high accelerating effects. Especially preferable are the compounds disclosed in U.S. Pat. Nos. 3,893,858, West German Patent No. 1,290,812, and Japanese Patent Laid-Open No. 53-95,630. Also preferable is the compound disclosed in U.S. Pat. No. 4,552,834. These bleaching accelerators can be added to the sensitive material. These bleaching accelerators prove particularly effective when bleaching and fixing sensitive material for photography.

The fixer used may be selected from among thiosulfates, thiocyanates, thioether type compounds, thioureas, a large amount of iodide salt, etc. Of these, thiosulfates are generally adopted, and, especially, ammonium thiosulfate can be used most widely. As the preservative for the bleaching/fixing agent, sulfite, bisulfite, or a carbonyl bisulfite adduct is particularly preferable. The sulfinic acids disclosed in Japanese Patent Application No. 62-142941 may also be used as the preservative.

The most preferable form of the concentrated liquid for the bleaching/fixing replenisher in this invention contains 0.20 to 0.50 mol/l of a complex of iron aminopolycaroxylate (III) as the bleaching agent, 0.80 to 1.50 mol/l of ammonium thiosulfate salt as the fixing agent, and 0.20 to 0.60 mol/l of sulfite as the preservative.

The silver halide sensitive material for color photography in this invention is generally subjected to the water washing and/or the stabilizing process after desilverization. The amount of water used in the water washing process can be set in accordance with such conditions as the characteristic of the sensitive material (e.g., coupler), the use, the temperature of the washing water, the number of water washing tanks (number of stages), the type of replenishing system (counter or following current), etc. Of these conditions, the relationship between the number of washing tanks and the amount of water used in a multistage counter-current system can be obtained by the method described in "Journal of the Society of Motion Picture and Television Engineers", vol. 64, pages 248 to 253 (May 1955 issue).

In accordance with the multistage counter-current system described in the above-mentioned reference, the washing water amount can be substantially reduced. However, due to the increase in the time the water stays in the tank, bacteria propagate therein, with the resulting suspended matter adhering to the sensitive material. In the processing of color sensitive material in the developing apparatus of the present invention, this problem can be overcome, utilizing very effectively the method of reducing calcium and magnesium ions which is described in Japanese Patent Laid-Open No. 62-288838. In this regard, it may be possible to employ germicides such as an isothiazolone compound disclosed in Japanese Patent Laid-Open No. 57-8,542, thiabendazols, or chlorine type germicides such as chlorinated sodium isocyanide. Further, other germicides including benzotriazol, etc., may be adopted which are described in "Chemistry of Germicides and Mildewcides" by Hiroshi Horiguchi, "Degerming, Sterilizing and Mildewcide Techniques" compiled by the Hygienics Society, and "Dictionary of Germicides and Mildewcides" compiled by the Japan Anti-Bacteria/Anti-Mildew Society.

The washing water for processing sensitive material in accordance with this invention exhibits a pH in the range 4 to 9, preferably, 5 to 8. The water temperature and the washing time may be set in accordance with the characteristic of the sensitive material used and its use. Generally speaking, the setting may be determined as: 20 sec. to 10 min. at 15° to 45° C., more preferably, 30 sec. to 5 min. at 25° to 45° C. Further, the sensitive material used in this invention can be directly processed by means of a stabilizer instead of water washing. For this stabilizing processing, all the well-known methods disclosed in Japanese Patent Laid-Opens No. 57-8,543, 58-14,834 and 60-220,345 can be used.

In some cases, a stabilizing process is added subsequent to the water washing. An example of such a stabilizing process is a stabilizing bath containing formalin and a surface active agent which is used as the last bath for color sensitive material for photography. Various chelating agents and mildewcides may also be added to this stabilizing bath.

The overflow liquid resulting from the above-mentioned water washing and/or the replenishment of the stabilizer can be reused in other processes such as desilverization.

In particular, it is desirable in this invention that the water washing be performed subsequent to the stabilizing process since it helps to stabilize the bleaching/fixing agent and enhances the stabilizing effect. In this regard, most preferably used is the method disclosed in Japanese Patent Laid-Open No. 62-288838 in which ion exchange water is used.

To simplify and quicken the processing, the silver halide color sensitive material used in this invention may contain the principal color developer from the first. In order to realize this, various precursors of the principal color developer are preferably used. Examples of such precursors include: the indoaniline system compound disclosed in U.S. Pat. No. 3,342,597, the Schiff-base type compounds disclosed in U.S. Pat. No. 3,342,599 and Research Disclosures No. 14,850 and 15,159, the aldol compound disclosed in Research Disclosure No. 13,924, the metal salt complex disclosed in U.S. Pat. No. 3,719,492, and the urethane system compound disclosed in Japanese Pat. Laid-Open No. 53-135,628.

The silver halide color sensitive material used in this invention may contain, as needed, various 1-phenyl-3-pirazolidones for the purpose of accelerating the color development. Examples of typical compounds of the type include those disclosed in Japanese Pat. Laid-Opens No. 56-64,339, 57-144,547, and 58-115,438.

The processing liquids in this invention are used in the temperature range 10° C. to 15° C. The normal processing temperature is in the range 33° C. to 38° C. It is possible to accelerate development by raising the temperature. By lowering the temperature, the image quality and the stability of the processing liquids can be improved. To economize on the silver in the sensitive material, the processing method disclosed in West German Pat. No. 2,226,770 or U.S. Pat. No. 3,674,499 uses cobalt intensification or hydrogen peroxide intensification.

As needed, the processing baths may be equipped with heaters, temperature sensors, liquid level sensors, circulating pumps, filters, floating lids, squeegees, etc.

DETAILED DESCRIPTION OF THE PREFERRED EMBODIMENTS

Embodiments of this invention will now be described with reference to the accompanying drawings.

Figure 1:
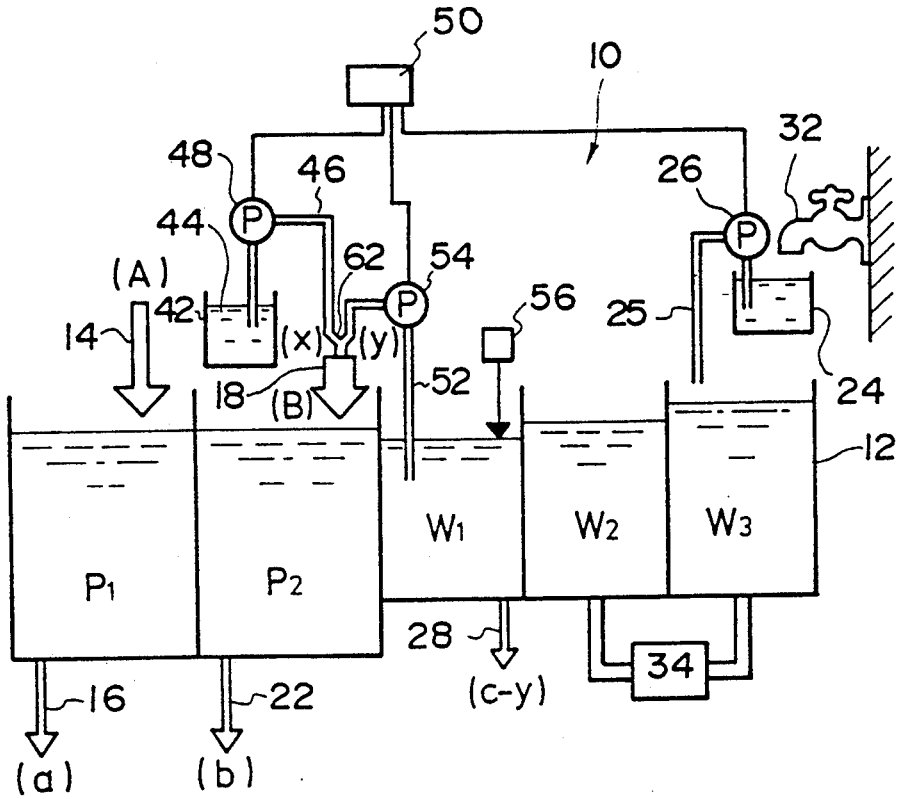
FIG. 1 is a schematic view showing a developing apparatus to which this invention is applied.

FIG. 1 shows a first embodiment of the photographic developing apparatus of this invention. This embodiment is particularly suited for developing a sensitive material for printing such as photographic paper. As shown in FIG. 1, it comprises a photographic apparatus 10 including a body 12 having a plurality of partitions defining a developing vessel P1, a bleaching/fixing vessel P2, and water washing vessels W1, W2 and W3.

The developing vessel P1 and the bleaching/fixing vessel P2 are filled with a developer and a bleaching-/fixing agent, respectively. The water washing vessels W1, W2 and W3 are filled with washing water. Each of these vessels is equipped with a well-known conveying means (not shown) having a holding/conveying roller as its principal part and adapted to successively pass sensitive material through these vessels. Thus, sensitive material whose images have been exposed is successively passed through the developing vessel P1, the bleaching/fixing vessel P2, and the water washing vessels W1, W2 and W3, thereby performing a series of development processes. The material is then dried to make a final product.

Supplied to the developing vessel P1 from a processing liquid replenishing device (not shown) is replenishment processing liquid 14 of a certain amount A, with the resulting overflow of a certain amount (a) being discharged as overflow processing liquid 16.

Likewise, the bleaching/fixing vessel P2 is also supplied with replenishment processing liquid 18 of a certain amount B, with the resulting overflow of a certain amount (b) being discharged as overflow processing liquid 22. By virtue of this arrangement, the amount of the processing liquid in the bleaching/fixing vessel P2 is kept constant, and, at the same time, its processing capacity is retained at a sufficient level.

Depending on the opening of pipe 25 and pump 26, which is controlled by means of a controller 50, processing liquid is supplied from a replenishment water tank 24 to the water washing vessel W3. The resulting overflow of this water washing vessel V3 is transferred to water washing vessel W2, and then to water washing vessel W1. Thus, it is transferred in the direction reverse to that in which the sensitive material is passed. The overflow washing water 28 is discharged from the water washing vessel W1. This arrangement allows fresh washing water to be constantly supplied to the water washing vessel W3 which constitutes the vessel for the last stage of sensitive material processing. The replenishment water tank 24 is supplied with tap water 32, with its water content being constantly kept at a certain level. It will be still more preferable if this tap water is ion exchange water as described in Japanese Pat. Laid-Open No. 62-28838. The washing water in the water washing vessel W2 can be circulated, as needed, to the water washing vessel W3 after being purified by a purifying device 34 which utilizes reverse osmosis, etc.

In this embodiment, the replenishment processing liquid 18 consists of a mixture of concentrated replenishment processing liquid 44 in a replenishment processing liquid tank 42 and washing water extracted from the water washing vessel W1. Thus, when the controller 50 determines that the bleaching/fixing vessel P2 should be replenished with the processing liquid, the concentrated replenishment processing liquid 44 is supplied, in a certain amount (x), to the bleaching/fixing vessel P2 through pipe 46 and a pump 48 which is controlled by the controller 50. At the same time, the washing water in the water washing vessel W1 is supplied, in a certain amount (y), to the bleaching/fixing vessel P2 through pipe 52 and a pump 54 which is controlled by the controller 50. The sum of the replenishment amounts (x) and (y) constitutes the replenishment processing liquid amount B. The ratio of the amount (x) to the amount (Y) is determined by the controller 50 in such a manner as to be equal to the concentration of the processing liquid in the bleaching/fixing vessel P2.

The operation of this embodiment will now be described.

At the start of the development operation, the developing vessel P1 is adjusted to a certain temperature by means of a heater (not shown). Sensitive material (not shown) is successively passed through the processing vessels from this developing vessel P1. As the sensitive material is moved along, the amount of the developer in the developing vessel P1 decreases, partly through evaporation and partly as a result of some of it being transferred to the bleaching/fixing vessel P2 with the sensitive material. Accordingly, the developing vessel P1 is replenished with replenishment processing liquid 14, with the resulting overflow being discharged as overflow processing liquid 16.

Likewise, the processing liquid in the bleaching/fixing vessel P2 decreases or deteriorates, so that this vessel is supplied with replenishment processing liquid 18, with the resulting extra processing liquid being discharged as overflow processing liquid 22. In this embodiment, the replenishment processing liquid 18 consists of a mixture of concentrated replenishment processing liquid 44 and washing water from the water washing vessel W1. Alternatively, the liquid 44 in the amount (x) and the washing water in the amount (y) may be separately supplied to the bleaching/fixing vessel P2. In either case, the ratio of the amount (x) to the amount (y) is so determined that the concentration of the replenished liquid (x+y) becomes equal to the concentration of the liquid in the bleaching/fixing vessel P2. This is effected by adjusting the difference in discharge between the pumps 48 and 54. Alternatively, the respective operation times of the pumps may be changed while keeping their discharges constant. The washing water in the water washing tank W1, some of which is transferred to the bleaching/fixing vessel P2, is obtained as a result of the overflowing in the water washing vessels W1, W2 and W3. The water washing vessel W3 is replenished with washing water from the replenishment water tank 24.

With this arrangement, the amount of washing water discharged from the water washing vessel W1 as overflow washing water 28 is smaller than the discharge amount (c) in the case where no washing water is transferred from the water washing vessel W1 to the bleaching/fixing vessel P2. That is, the discharge amount in this embodiment is smaller than the above-mentioned discharge amount (c) by the supply amount (y) transferred from the water washing vessel W1 to the bleaching/fixing vessel P2 through the piping 52.

Table 1 shows the results of comparison between a prior art apparatus and this embodiment.

TABLE 1

| | Supply to P2 | Discharge from P2 | Discharge from W1 | Supply from W1 to P2 |
|---|---|---|---|---|
| Prior art | B = x + y | (b) | (c) | — |
| Embodiment | B = x + y | (b) | (c − y) | y |

As shown in Table 1, the replenishment amount to the bleaching/fixing vessel P2 and the discharge amount therefrom in the prior art apparatus are the same as in this embodiment. The only difference consists in the fact that the washing water for dilution in the amount (y), which makes up, together with the amount (x) of the concentrated replenishment processing liquid 44 the replenishment amount B to the bleaching/fixing vessel P2, is supplied, in the prior art apparatus, from a tap or a separate replenishment water tank, whereas, in this embodiment, it is supplied from the water washing vessel W1 as transferred washing water. In the prior art apparatus, the amount of overflow washing water 28 discharged from the water washing vessel W1 is equal to the amount (c) supplied from the water washing vessel W2 through overflowing. In this embodiment, the amount of washing water discharged corresponds to the value obtained by subtracting the amount (y) of washing water transferred to the bleaching/fixing vessel P2 as washing water for dilution from the amount (c) supplied from the washing vessel W1, resulting in the discharge amount being that much smaller.

When the amount of washing water transferred from the water washing vessel W1 is much smaller than the amount of washing water supplied from the replenishing water tank 24 to the water washing vessel W3, no particular problem is involved since the liquid level in the water washing vessel W1 can be kept at its maximum. The replenishment amount (x) of concentrated replenishment processing liquid 44 varies in accordance with the area ($m^2$) of the surface of the sensitive material processed. Generally speaking, it is in the range 50 to 100 ml/$m^2$. The amount of washing water extracted from the water washing vessel W1 is the range 50 to 200 ml/$m^2$. The amount of washing water supplied from the replenishment water tank 24 to the water washing vessel W3 is about 300 to 400 ml. At this rate, the liquid level in the water washing vessel W1 is not materially lowered when a usual amount of sensitive material is being processed.

However, when, for example, operating the purifying device 34, the amount of washing water supplied from the replenishment water tank 24 to the water washing vessel W3 is reduced to 120 ml or thereabouts, so that the amount of washing water transferred from the water washing vessel W1 to the bleaching/fixing vessel P2 can become equal to or greater than the amount of water discharged as overflow washing water 28, depending on the quantity of sensitive material processed.

Since this results in the water level in the water washing vessel W1 being lowered, it is desirable that the pump 26 be operated in response to the operation of the pump 54 or 48 so that washing water may be supplied from the replenishment water tank 24 to the water washing vessel W3 in an amount corresponding to the difference between the amount of washing water (y) transferred from the water washing vessel W1 to the bleaching/fixing vessel P2 and the amount of overflow washing water transferred from the water washing vessel W2 to the water washing vessel W1.

Figure 3:
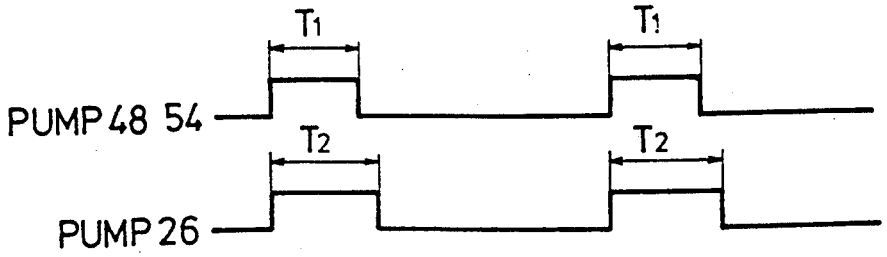
FIG. 3 is a chart showing the operational timings in the individual pumps used.
Figure 2:
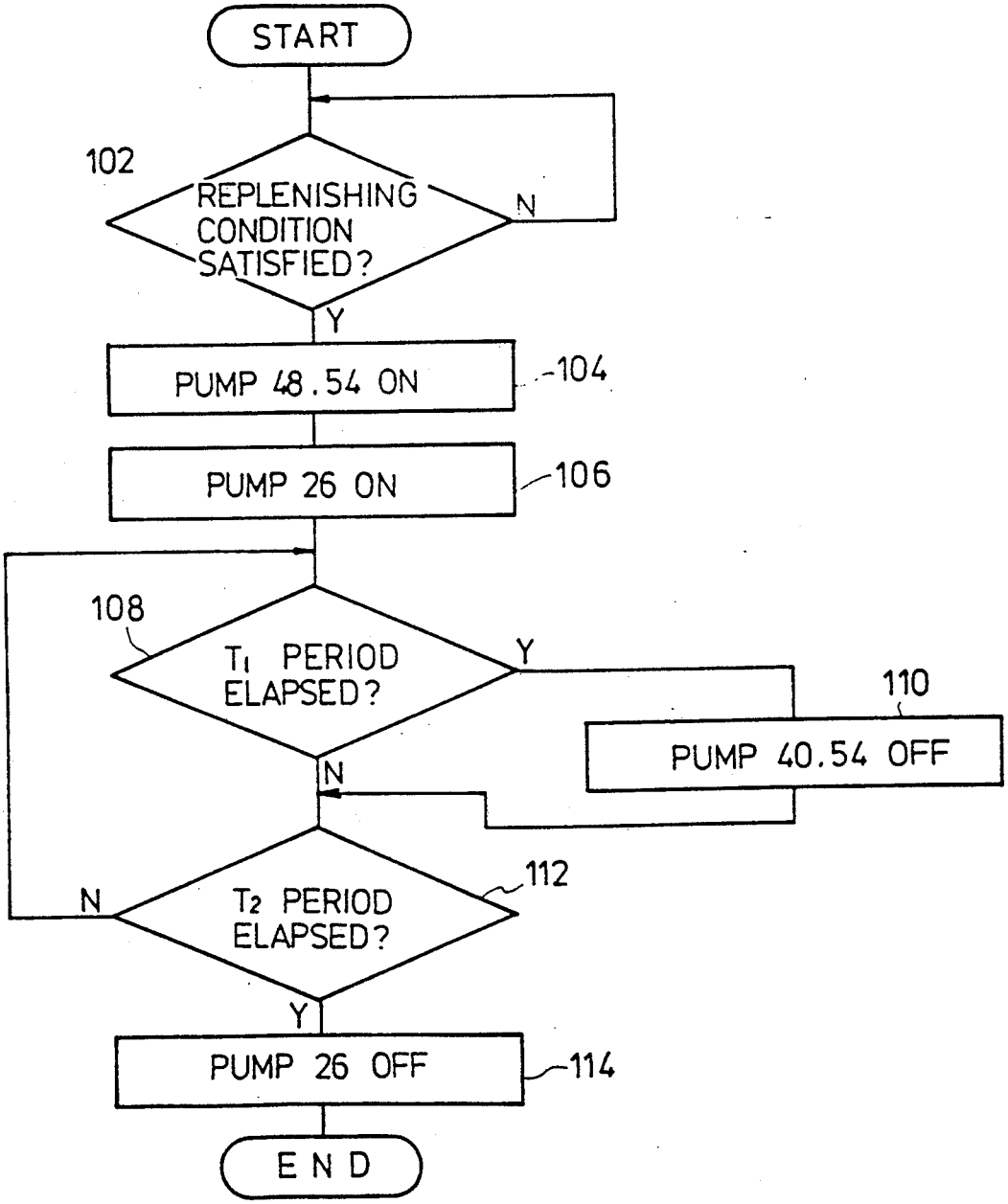
FIG. 2 is a flowchart showing the washing water supply process in the embodiment shown in FIG. 1.

This will be explained with reference to FIGS. 2 and 3. First, in Step 102, it is determined whether or not the bleaching/fixing vessel P2 requires replenishing with processing liquid. This determination is made when a predetermined number of sensitive material pieces or a predetermined length of sensitive material has passed through the bleaching/fixing vessel P2. The pumps 48 and 54 are then operated (Step 104), concentrated replenishment processing liquid 44 and washing water from the water washing vessel W1 being mixed with each other and supplied to the bleaching/fixing vessel P2. Since the ratio of the discharge of the pump 48 to that of the pump 54 is previously determined to be equal to the mixing ratio of the concentrated replenishment processing liquid 44 to the amount of washing water transferred from the water washing vessel W1, both can be supplied for a predetermined period of time T1. When this predetermined period ends, the pumps 48 and 54 stop their operation (Steps 108 and 110). If, however, the discharge ratio of the pumps 48 and 54 is not set to be equal to the above-mentioned mixing ratio, the respective operation times of the pumps have to be different from each other.

Simultaneously with the operation of the pumps 48 and 54, the pump 26 is also operated for a predetermined period of time T2 (Steps 112 and 114). This period T2 is so determined that the liquid level in the water washing vessel W1 is not lowered even when washing water in the amount (y) is transferred from this water washing vessel to the bleaching/fixing vessel P2. If, at this point of time, the water washing vessel W3 is being supplied with washing water only from the replenishment water tank 24, the amount of water supplied from the replenishment tank 24 to the water washing vessel W3 is adjusted to be equal to or slightly larger than the amount (y). Thus, if the operation time T1 of the pumps 48 and 54 is constant, the operation time T2 can also be constant. However, if the operation time T1 is different under different operational conditions, it is convenient to determine the ratio of the operation time T2 to the operation time T1 beforehand.

Further, it is also possible to provide a liquid level sensor 56 in the water washing vessel W1. The pump 26 can then be operated until the water washing vessel W1 is filled with washing water to a certain level. Or, it can be so arranged that, when this liquid level pump 56 detects a certain water level, the pump 26 operates for a certain period of time, supplying a certain amount of water to the water washing vessel W3.

Figure 4:
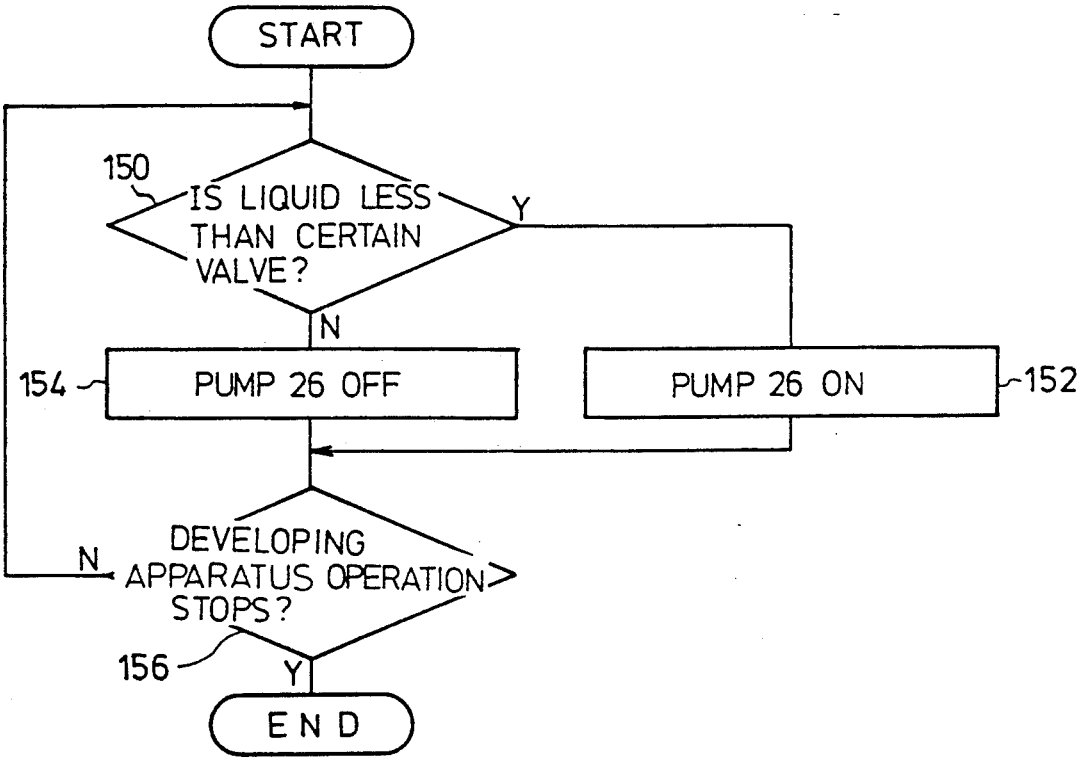
FIGS. 4 and 5 a flowcharts showing the washing water supply process in other embodiments.

FIG. 4 is a flowchart illustrating the control process for keeping the water level in the water washing vessel W1 constantly above a certain value by means of the liquid level sensor 56.

That is, when the liquid level in the water washing vessel W1 falls below a certain value as a result of washing water in this vessel being transferred to the bleaching/fixing vessel P2, the pump 26 is operated to cause the water washing vessel W3 to be supplied with washing water from the replenishment water tank 24 (Steps 150 and 152). As a result of this water supply, washing water is transferred, through overflow, from the water washing vessel W3 to the water washing vessel W2, and, from the water washing vessel W2 to the water washing vessel W1. This causes the liquid level in the water washing vessel W1 to be raised, and, when the original water level therein has been restored, this is detected by the liquid level sensor 56 and the pump 26 is stopped, thus stopping the operation of the developing apparatus. The control process is then terminated (Steps 150, 154 and 156)

Figure 5:
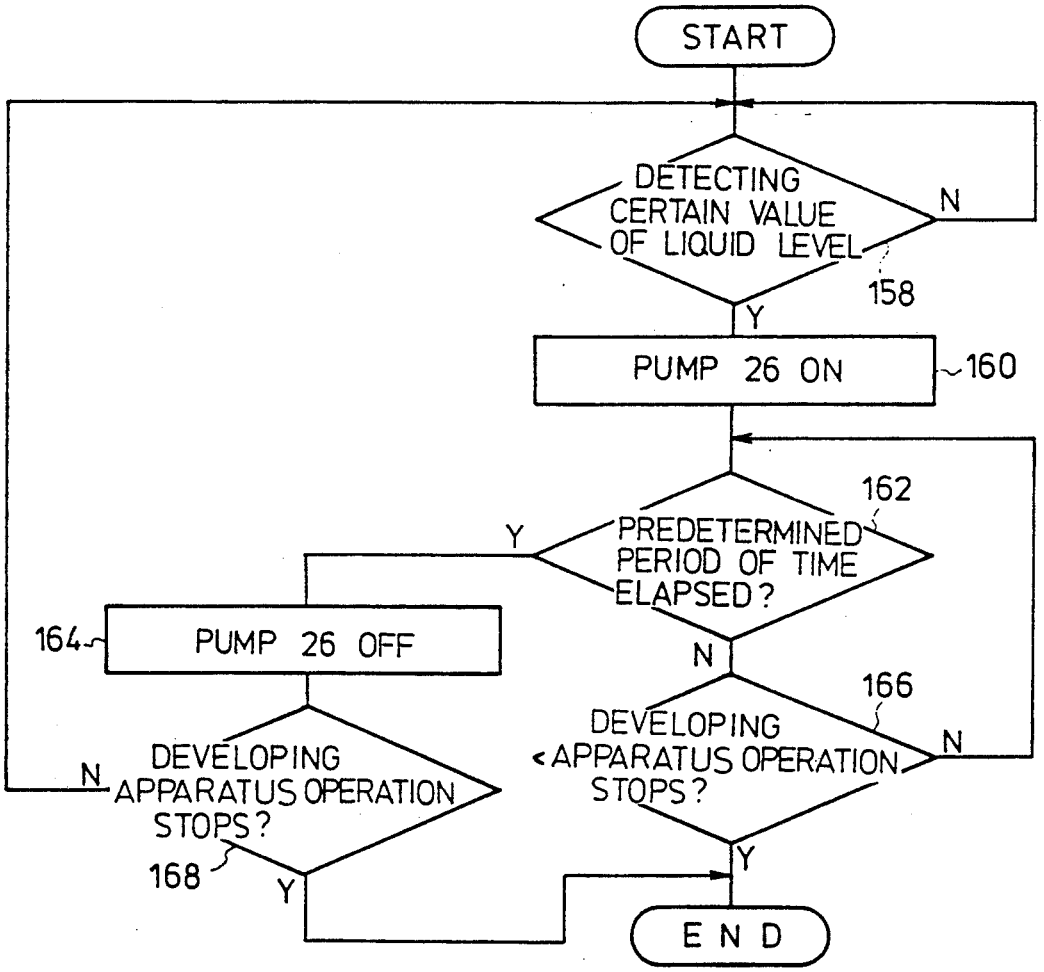

In the case of the control process shown in FIG. 5, it is so designed that, when the water level in the water washing vessel W1 has been reduced to a certain value, this is detected by the liquid level sensor 56 (Step 158). The pump 26 then operates for a predetermined period of time to supply a certain amount of washing water (Steps 160, 162 and 164) to the water washing vessel W3, thereby preventing the water level in the water washing vessel W1 from falling below a certain value. This can result in washing water overflowing from the water washing vessel W1, which also causes the developing apparatus to stop operation, thereby ending the control process.

Figure 6:
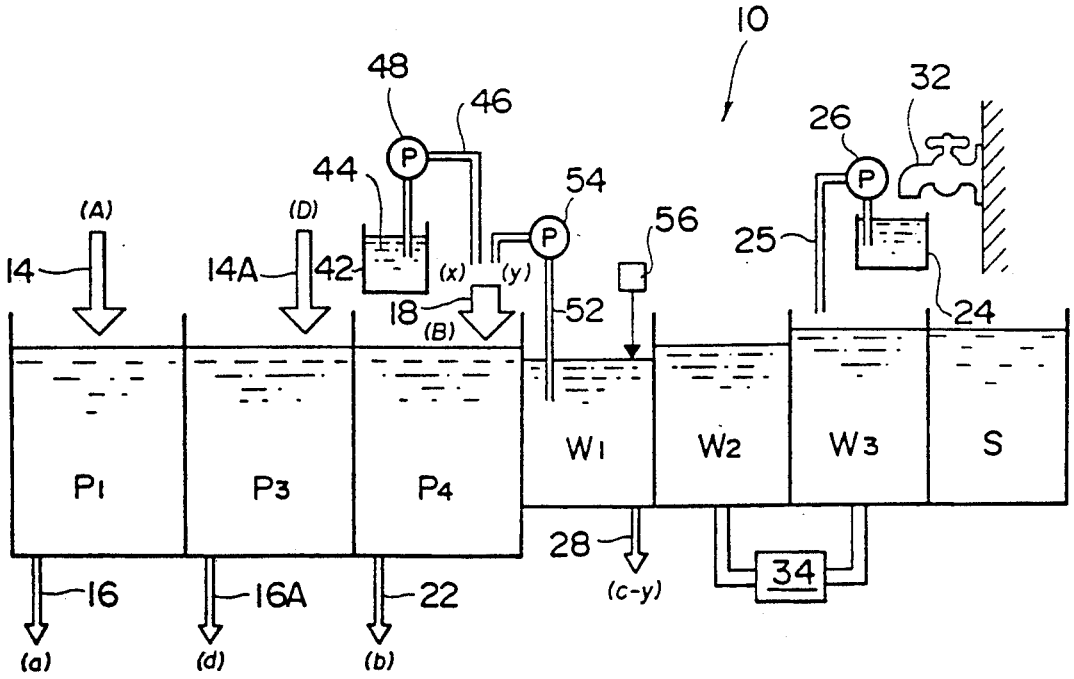
FIGS. 6 and 7 are schematic views of developing apparatuses to which a first and a second embodiment of this invention are applied, respectively.

FIG. 6 shows a second embodiment of this invention. This invention is suited for cases where the sensitive material processed consists of a sensitive material for photography such as negative film or reversal film. Provided on the downstream side of the developing vessel P1 are a bleaching vessel P3 and a fixing vessel P4, and provided on the downstream side of the fixing vessel P4 are water washing vessels W1, W2 and W3 as well as a stabilizing vessel S.

Like the bleaching vessel P1, the bleaching vessel P3 is supplied with replenishment processing liquid 14A in an amount D from a processing liquid replenishing device (not shown). The extra liquid in an amount of d is discharged as overflow processing liquid 16A.

Like the bleaching/fixing vessel P2 in the above-described embodiment, the fixing vessel P4 of this embodiment is supplied with replenishment processing liquid whose concentration is adjusted to a predetermined value by mixing the concentrated replenishment processing liquid 44 with washing water from the water washing vessel W1. Thus, the amount of liquid discharged from the water washing vessel W1 in this embodiment is also (c−y), a value smaller than the discharge amount c in the prior art.

If the water level in the water washing vessel W1 is lowered, the pump 26 is operated so as to supply washing water from the replenishment water tank 24 to the water washing vessel W3, as in the first embodiment.

Figure 7:
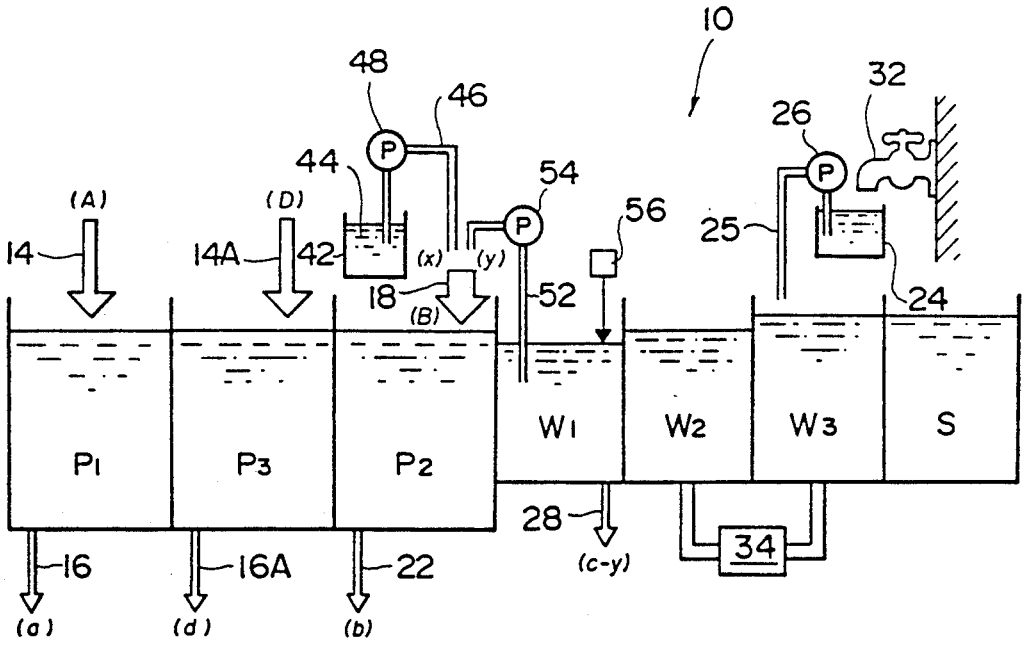

FIG. 7 shows a third embodiment of this invention. Like the above-described second embodiment, this embodiment is suited for processing sensitive materials for photography such as negative film and reversal film. As in the above-described second embodiment, a bleaching vessel P3 is provided on the downstream side of the developing vessel P1, a stabilizing vessel S being arranged on the downstream side of the water washing vessel W3. However, a bleaching/fixing vessel P2 is arranged on the downstream side of the bleaching vessel P3, as in the first embodiment, and a mixture of concentrated replenishment processing liquid 44 and washing water from the water washing vessel W1 is supplied thereto, as in the first embodiment, thus providing a similar effect. The other aspects in structure and control of this embodiment are the same as those of the first embodiment.

In the above-described embodiments, washing water from the vessel W1 and concentrated replenishment processing liquid 44 are separately supplied to the bleaching/fixing vessel P2 or the fixing vessel P4 to be mixed with each other therein. Alternatively, washing water may enter a Y-shaped pipe on one side thereof, and concentrated replenishment processing liquid 44 may enter this pipe on the other side thereof, both liquids being mixed with each other in this pipe before they are supplied to the bleaching/fixing vessel P2 or the fixing vessel P4. Further, it is also possible to convey both washing water and concentrated replenishment processing liquid 44 to a separately provided replenishment tank and mix them with each other therein before supplying them to the bleaching/fixing vessel P2 or the fixing vessel P4.

What is claimed is:

1. A photographic developing apparatus of the type in which development is effected by passing exposed sensitive material successively through a developing vessel, a bleaching/fixing vessel, and a rinsing vessel which comprises at least one of a water washing vessel and stabilizing vessel; comprising:

(a) a first supply means for supplying said bleaching-/fixing vessel with concentrated replenishment processing liquid for bleaching and fixing:

(b) a second supply means for extracting liquid from said rinsing vessel and transferring said extracted liquid to said bleaching/fixing vessel; and (c) an adjustment means for adjusting the ratio of the amount of said concentrated replenishment processing liquid to that of said liquid extracted from said rinsing vessel to a previously determined bleaching/fixing replenishment liquid concentration, whereby the amount of waste liquid discharged from said rinsing vessel is reduced by the amount of liquid extracted from said rinsing vessel.

2. A photographic developing apparatus as claimed in claim 1, wherein a plurality of said rinsing vessels are arranged in a series, replenishment liquid for these rinsing vessels being supplied to a rearmost rinsing vessel which is farthest from said bleaching/fixing vessel, and wherein said replenishment liquid is successively transferred, through overflow, from said rearmost rinsing vessel to a foremost rinsing vessel which is nearest to said bleaching/fixing vessel, thus constituting a counter flow with respect to the direction in which said sensitive material is conveyed, said replenishment liquid thus transferred being conveyed from said foremost rinsing vessel to said bleaching/fixing vessel.

3. A photographic developing apparatus as claimed in claim 2, wherein said rearmost rinsing vessel is supplied with rinsing liquid when liquid is extracted from said foremost rinsing vessel by said second supply means.

4. A photographic developing apparatus as claimed in claim 1, wherein a desired replenishment liquid concentration is attained by adjusting the ratio of the amount of liquid conveyed by said first supply means to that conveyed by said second supply means to a predetermined value.

5. A photographic developing apparatus as claimed in claim 1, wherein said concentrated replenishment processing liquid and the liquid extracted from said rinsing vessel are mixed with each other by a mixing means before they are supplied to said bleaching/fixing vessel.

6. A photographic developing apparatus as claimed in claim 1, further comprising a liquid level sensor which is provided in said rinsing vessel, the liquid level of this rinsing vessel being kept at a certain value by a third supply means.

7. A photographic developing apparatus as claimed in claim 6, wherein said rinsing vessel is supplied with liquid until said liquid level sensor detects a certain liquid level.

8. A photographic developing apparatus as claimed in claim 6, wherein said third supply means performs liquid supply for a certain period of time which is determined on the basis of the detection effected by said liquid level sensor.

9. A photographic developing apparatus as claimed in claim 1, wherein a plurality of said rinsing vessels are arranged in a series, replenishment liquid for these rinsing vessels being supplied to a rearmost rinsing vessel which is farthest from said bleaching/fixing vessel, and wherein replenishment liquid is successively transferred, through overflow, from said rearmost rinsing vessel to a foremost rinsing vessel which is nearest to said bleaching/fixing vessel, thus constituting a counter flow with respect to the direction in which said sensitive material is passed, said replenishment liquid thus transferred being conveyed from said foremost rinsing vessel to said bleaching/fixing vessel, and wherein said rearmost rinsing vessel is supplied with rinsing liquid while said bleaching/fixing vessel is being supplied with rinsing liquid from said foremost rinsing vessel.

10. A photographic developing apparatus as claimed in claim 1, further comprising a liquid level sensor for controlling the liquid supply to said rearmost rinsing vessel.

11. A photographic developing apparatus of the type in which development is effected by passing exposed sensitive material successively through a developing vessel, a bleaching/fixing vessel, and a rinsing vessel which constitutes at least one of a water washing and a stabilizing vessel; comprising:

(a) a reserving means for reserving concentrated replenishment processing liquid for bleaching and fixing which is to be supplied to said bleaching/fixing vessel;

(b) a supply means for supplying said bleaching/fixing vessel with concentrated replenishment processing liquid from said reserving means and processing liquid for dilution from said rinsing vessel; and (c) means for adjusting the ration of the amount of concentrated replenishment processing liquid and that of processing liquid for dilution which are supplied by said supply means to the concentration of the processing liquid in said bleaching/fixing vessel.

12. A photographic developing apparatus as claimed in claim 11, wherein said supply means includes a pump for supplying said bleaching/fixing vessel with said concentrated replenishment processing liquid and a pump for supplying said bleaching/fixing vessel with processing liquid for dilution from said rinsing vessel.

13. A photographic developing apparatus as claimed in claim 11, wherein said supply means mixes said concentrated replenishment processing liquid with said processing liquid for dilution from said rinsing vessel before supplying them to said bleaching/fixing vessel.

14. A photographic developing apparatus as claimed in claim 11, wherein a plurality of said rinsing vessels are arranged in a series, replenishment liquid for these rinsing vessels being supplied to a rearmost rinsing vessel which is farthest from said bleaching/fixing vessel, and wherein replenishment liquid is successively transferred, through overflow, from said rearmost rinsing vessel to a foremost rinsing vessel which is nearest to said bleaching/fixing vessel, thus constituting a counter flow with respect to the direction in which said sensitive material is passed, said replenishment liquid thus transferred being conveyed from said foremost rinsing vessel to said bleaching/fixing vessel.

15. A photographic developing apparatus as claimed in claim 14, wherein said rearmost rinsing vessel is supplied with washing water or a stabilizer when extracting processing liquid for dilution from said foremost rinsing vessel.

16. A photographic developing apparatus as claimed in claim 15, wherein said foremost rinsing vessel is equipped with a liquid level sensor, the supply of processing liquid to said rearmost rinsing vessel being controlled on the basis of a predetermined liquid level to be detected by said liquid level sensor.

17. A photographic developing apparatus as claimed in claim 15, wherein said foremost rinsing vessel is equipped with a liquid level sensor, said rearmost rinsing vessel being supplied with a predetermined amount of processing liquid in accordance with the detection effected by said liquid level sensor.

18. A photographic developing apparatus of the type in which development is effected by passing exposed sensitive material successively through a developing vessel, a bleaching/fixing vessel, and at least one of a water washing and a stabilizing vessel which comprises a plurality of rinsing vessels; comprising:

(a) a reserving means for reserving concentrated replenishment processing liquid for bleaching and fixing which is to be supplied to said bleaching/fixing vessel;

(b) a first pump for supplying concentrated replenishment processing liquid from said reserving means to said bleaching/fixing vessel;

(c) a second pump for supplying rinsing liquid from said plurality of rinsing vessels to said bleaching-/fixing vessel;

(d) a control means for controlling said first and second pumps to mix said concentrated replenishment processing liquid with said rinsing liquid in a predetermined mixing ratio; and (e) a supply means for supplying rinsing liquid to a rearmost rinsing vessel which is farthest from said bleaching/fixing vessel.

19. A photographic developing apparatus as claimed in claim 18, wherein a liquid sensor is provided in a foremost rinsing vessel which is nearest to said bleaching/fixing vessel, the amount of liquid supplied by said supply means being adjusted such that the liquid level of said foremost rinsing vessel is kept at a certain value.

20. A photographic developing apparatus as claimed in claim 18, wherein said rearmost rinsing vessel is supplied with a predetermined amount of processing liquid when processing liquid is transferred from said foremost rinsing vessel to said bleaching/fixing vessel.

21. A photographic developing apparatus of the type in which development is effected by passing exposed sensitive material successively through a developing vessel, a bleaching vessel, a fixing vessel, and a rinsing vessel which constitutes at least one of a water washing vessel and stabilizing vessel; comprising:

(a) a first supply means for supplying said fixing vessel with concentrated replenishment processing liquid for fixing;

(b) a second supply means for extracting liquid from said rinsing vessel and transferring said extracting liquid to said fixing vessel; and (c) an adjusting means for adjusting the ratio of the amount of said concentrated replenishment processing liquid to that of said liquid extracted from said rinsing vessel to a previously determined fixing-replenishment-liquid concentration, whereby the amount of waste liquid discharged from said rinsing vessel is reduced by the amount of liquid extracted from said rinsing vessel.

22. A photographic developing apparatus as claimed in claim 21, wherein a plurality of said rinsing vessels are arranged in a series, replenishment liquid for these rinsing vessels being supplied to a rearmost rinsing vessel which is farthest from said fixing vessel, and wherein said replenishment liquid is successively transferred, through overflow, from said rearmost rinsing vessel to a foremost rinsing vessel which is nearest to said fixing vessel, thus constituting a counter flow with respect to the direction in which said sensitive material is conveyed, said replenishment liquid thus transferred being conveyed from said foremost rinsing vessel to said fixing vessel.

23. A photographic developing apparatus as claimed in claim 22, wherein said rearmost rinsing vessel is supplied with rinsing liquid when liquid is extracted from said foremost rinsing vessel by said second supply means.

24. A photographic developing apparatus as claimed in claim 21, wherein a desired replenishment liquid concentration is attained by adjusting the ratio of the amount of liquid conveyed by said first supply means to that conveyed by said second supply means to a predetermined value.

25. A photographic developing apparatus as claimed in claim 21, wherein said concentrated replenishment processing liquid and the liquid extracted from said rinsing vessel are mixed with each other by a mixing means before they are supplied to said fixing vessel.

26. A photographic developing apparatus as claimed in claim 21, further comprising a liquid level sensor which is provided in said rinsing vessel, the liquid level of this rinsing vessel being kept at a certain value by a third supply means.

27. A photographic developing apparatus as claimed in claim 26, wherein said rinsing vessel is supplied with liquid until said liquid level sensor detects a certain liquid level.

28. A photographic developing apparatus as claimed in claim 26, wherein said third supply means performs liquid supply for a certain period of time which is determined on the basis of the detection effected by said liquid level sensor.

29. A photographic developing apparatus as claimed in claim 21, wherein a plurality of said rinsing vessels are arranged in a series, replenishment liquid for these rinsing vessels being supplied to a rearmost rinsing vessel which is farthest from said fixing vessel, and wherein replenishment liquid is successively transferred, through overflow, from said rearmost rinsing vessel to a foremost rinsing vessel which is nearest to said fixing vessel, thus constituting a counter flow with respect to the direction in which said sensitive material is passed, said replenishment liquid thus transferred being conveyed from said foremost rinsing vessel to said fixing vessel, and wherein said rearmost rinsing vessel is supplied with rinsing liquid while said fixing vessel is being supplied with rinsing liquid from said foremost rinsing vessel.

30. A photographic developing apparatus as claimed in claim 21, further comprising a liquid level sensor for controlling the liquid supply to said rearmost rinsing vessel.

31. A photographic developing apparatus of the type in which development is effected by passing exposed sensitive material successively through a developing vessel, a bleaching vessel, a bleaching/fixing vessel, and a rinsing vessel which constitutes at least one of a water washing and a stabilizing vessel; comprising:

(a) a first supply means for supplying said bleaching-/fixing vessel with concentrated replenishment processing liquid for bleaching and fixing;

(b) a second supply means for extracting liquid from said rinsing vessel and transferring it to said bleaching/fixing vessel; and (c) an adjustment means for adjusting the ration of the amount of said concentrated replenishment processing liquid to that of said liquid extracted from said rinsing vessel to a previously determined bleaching/fixing replenishment liquid concentration, whereby the amount of waste liquid discharged from said rinsing vessel is reduced by the amount of liquid extracted from said rinsing vessel.

32. A photographic developing apparatus as claimed in claim 31, wherein a plurality of said rinsing vessels are arranged in a series, replenishment liquid for these rinsing vessels being supplied to a rearmost rinsing vessel which is farthest from said bleaching/fixing vessel, and wherein said replenishment liquid is successively transferred, through overflow, from said rearmost rinsing vessel to a foremost rinsing vessel which is nearest to said bleaching/fixing vessel, thus constituting a counter flow with respect to the direction in which said sensitive material is conveyed, said replenishment liquid thus transferred being conveyed from said foremost rinsing vessel to said bleaching/fixing vessel.

33. A photographic developing apparatus as claimed in claim 32, wherein said rearmost rinsing vessel is supplied with rinsing liquid when liquid is extracted from said foremost rinsing vessel by said second supply means.

34. A photographic developing apparatus as claimed in claim 31, wherein a desired replenishment liquid concentration is attained by adjusting the ratio of the amount of liquid conveyed by said first supply means to that conveyed by said second supply means to a predetermined value.

35. A photographic developing apparatus as claimed in claim 31, wherein said concentrated replenishment processing liquid and the liquid extracted from said rinsing vessel are mixed with each other by a mixing means before they are supplied to said bleaching/fixing vessel.

36. A photographic developing apparatus as claimed in claim 31, further comprising a liquid level sensor which is provided in said rinsing vessel, the liquid level of this rinsing vessel being kept at a certain value by a third supply means.

37. A photographic developing apparatus as claimed in claim 36, wherein said rinsing vessel is supplied with liquid until said liquid level sensor detects a certain liquid level.

38. A photographic developing apparatus as claimed in claim 36, wherein said third supply means performs liquid supply for a certain period of time which is determined on the basis of the detection effected by said liquid level sensor.

39. A photographic developing apparatus as claimed in claim 31, wherein a plurality of said rinsing vessels are arranged in a series, replenishment liquid for these rinsing vessels being supplied to a rearmost rinsing vessel which is farthest from said bleaching/fixing vessel, and wherein replenishment liquid is successively transferred, through overflow, from said rearmost rinsing vessel to a foremost rinsing vessel which is nearest to said bleaching/fixing vessel, thus constituting a counter flow with respect to the direction in which said sensitive material is passed, said replenishment liquid thus transferred being conveyed from said foremost rinsing vessel to said bleaching/fixing vessel, and wherein said rearmost rinsing vessel is supplied with rinsing liquid while said bleaching/fixing vessel is being supplied with rinsing liquid from said foremost rinsing vessel.

40. A photographic developing apparatus as claimed in claim 31, further comprising a liquid level sensor for controlling the liquid supply to said rearmost rinsing vessel.

* * * * *